US010376067B2

(12) United States Patent
Aldrich et al.

(10) Patent No.: US 10,376,067 B2
(45) Date of Patent: Aug. 13, 2019

(54) ADJUSTABLE BACK SUPPORT FOR A SEATING SURFACE

(71) Applicant: Herman Miller, Inc., Zeeland, MI (US)

(72) Inventors: John Aldrich, Grandville, MI (US); Thomas Hornor, Jenison, MI (US); Elindo Castro, Wyoming, MI (US); Adwait Bhagwat, Holland, MI (US); Jeffrey Koffman, Santa Monica, CA (US)

(73) Assignee: Herman Miller, Inc., Zeeland, MI (US)

( * ) Notice: Subject to any disclaimer, the term of this patent is extended or adjusted under 35 U.S.C. 154(b) by 93 days.

(21) Appl. No.: 15/620,105

(22) Filed: Jun. 12, 2017

(65) Prior Publication Data

US 2017/0354260 A1 Dec. 14, 2017

Related U.S. Application Data

(60) Provisional application No. 62/349,488, filed on Jun. 13, 2016.

(51) Int. Cl.
*A47C 5/02* (2006.01)
*A47C 7/46* (2006.01)
*A47C 7/28* (2006.01)

(52) U.S. Cl.
CPC ..... *A47C 7/462* (2013.01); *A47C 5/02* (2013.01); *A47C 7/282* (2013.01); *A47C 7/46* (2013.01)

(58) Field of Classification Search
CPC ..... A47C 7/462; A47C 7/282; A47C 7/46; A47C 5/02
USPC ..... 297/284.2
See application file for complete search history.

(56) References Cited

U.S. PATENT DOCUMENTS 4,156,544 A * 5/1979 Swenson ..... B60N 2/666 297/284.4
6,059,362 A * 5/2000 Lin ..... A47C 7/425 297/284.4
6,354,662 B1 * 3/2002 Su ..... A47C 7/46 297/284.4
6,695,403 B1 * 2/2004 Su ..... A47C 1/03255 297/284.7
6,843,530 B1 * 1/2005 Wu ..... A47C 7/38 297/284.3

(Continued)

FOREIGN PATENT DOCUMENTS

TW M254959 U 1/2005

OTHER PUBLICATIONS

Extended European Search Report from the European Patent Office for Application No. 17175814.7 dated Nov. 7, 2017 (7 pages).

*Primary Examiner* — Mark R Wendell
(74) *Attorney, Agent, or Firm* — Michael Best & Friedrich LLP

(57) ABSTRACT

A back support for a chair includes a cover configured to be coupled to opposing sides of a chair frame. A strap is connected to the cover. A sled having a central portion is coupled to the strap, the sled is configured to pivot with respect to the chair frame and provide support to a user's back. The cover is configured to moveably connect to the chair frame between a low position and a high position. The sled is configured to pivot as the cover moves between the low position and the high position so that the central portion of the sled is substantially parallel to at least a portion of a membrane connected to the frame between the low position and the high position.

23 Claims, 9 Drawing Sheets

(56) References Cited

U.S. PATENT DOCUMENTS

| | | | | |
|---|---|---|---|---|
| 2004/0140701 | A1* | 7/2004 | Schmitz ..... | A47C 7/44<br>297/284.4 |
| 2005/0062323 | A1 | 3/2005 | Dicks | |
| 2009/0127905 | A1 | 5/2009 | Schmitz et al. | |

* cited by examiner

ADJUSTABLE BACK SUPPORT FOR A SEATING SURFACE

CROSS-REFERENCE TO RELATED APPLICATIONS

This application claims priority to U.S. Provisional Patent Application No. 62/349,488, filed Jun. 13, 2016, the entire contents of which are incorporated by reference herein.

FIELD

Various exemplary embodiments of the invention relate to a back support for a seating surface such as an office chair.

BACKGROUND

Seating structures may be configured with flexible backrest members, such as polypropylene sheets and woven elastomeric membranes. Typically, the flexible members are put in tension in various ways so as to provide the flexible member with a three-dimensional contour.

Although a flexible backrest can accommodate movements and shifts in the users positions some users become uncomfortable after sitting for long periods of time. This is particularly true if the person sitting in the chair is restricted in the postural positions that he or she can assume for reasons such as the work task that they are performing.

The spine is broken down into four general regions: cervical (neck), thoracic (upper back), lumbar (lower back) and sacral (tail bone). In a natural aligned spine, the thoracic spine has a kyphotic, or gentle convex curve when viewed from the side. A lordotic lumbar spine, when viewed from the side, has a slightly concave curve. The sacrum is the base of the spine. It is a large triangular fusion of five vertebrae wedged between the pelvic bones. The connection of these bones is called the sacroiliac joint. Back problems can occur where the lumbar spine connects to the sacrum. The lumbar vertebrae, and the surrounding muscles, tendons and ligaments are also a common source of discomfort for a great many people after sitting for prolonged periods.

Sitting up straight can be difficult for the users of many chairs. In particular, in many seating devices a void exists between the backrest of the chair and the sacrum of a user. As a result, the user of the chair may take a slouched position. By slouching, the user will be placed in a position of poor posture, lack of muscle control and discomfort. Slouching can lead to a number of immediate problems. For example, increased fatigue or fidgeting may result because of discomfort. In addition, undesirable physical effects such as increased pressure on the lumbar discs or the creation of muscle spasms may also result from slouching. Various long-term problems may also occur. For example, pain in the lower back muscles or discomfort between the shoulder blades may result. Also, the tightening of neck muscles and muscle soreness and headaches may result.

SUMMARY

According to an exemplary embodiment, a back support for a chair includes a cover configured to be coupled to opposing sides of a chair frame. A strap is connected to the cover. A sled having a central portion is coupled to the strap, the sled is configured to pivot with respect to the chair frame and provide support to a user's back. The cover is configured to moveably connect to the chair frame between a low position and a high position. The sled is configured to pivot as the cover moves between the low position and the high position so that the central portion of the sled is substantially parallel to at least a portion of a membrane connected to the frame between the low position and the high position.

According to another exemplary embodiment, a back support for a chair includes a cover configured to extend across the opening of the backrest and be coupled to opposing sides of a chair frame. The cover includes a first connection point adjacent one side of the frame and a second connection point adjacent an opposite side of the frame. A strap has a first end coupled to the first connection point of the cover, a second end coupled to the second connection point of the cover, and a central section between the first end and the second end. The strap is tensioned between the first and second connection points. A sled is coupled to the central section of the strap and pivotable with respect to the cover. The sled configured to engage a membrane connected to the frame to support a user.

According to another exemplary embodiment, a chair includes a base and a seat supported by the base. A backrest is adjacent the seat and includes a frame defining a central opening and a membrane coupled to the frame and suspended over the central opening. A cover is connected to the frame. A strap is connected to the cover. A sled is connected to the strap. The sled is configured to pivot with respect to the chair frame and provide support to a user's back. The cover is configured to moveably connect to the chair frame between a low position and a high position. The sled is configured to pivot as the cover moves between the low position and the high position so that the central portion of the sled is substantially parallel to at least a portion of a membrane connected to the frame between the low position and the high position.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Various exemplary embodiments are related to seating structures and methods of creating seating structures. Seating structures may include any structure used to support a body of a user, for example, without limitation, office chairs, chairs, sofas, airplane seats, vehicle seats, bicycle seats, boat seats, beds, dental and medical seats and beds, auditorium and educational seating, etc. It should be understood that the various methods and devices disclosed herein may be applied to seating structures other than a seat and/or backrest, including for example and without limitation armrests, headrests and other ergonomic positioning features. In addition, the various methods and devices may be applied to structures employing a frame and suspension material other than seating structures. Although the illustrated embodiments are shown in connection with an office chair, other embodiments can include different configurations.

Figure 1:
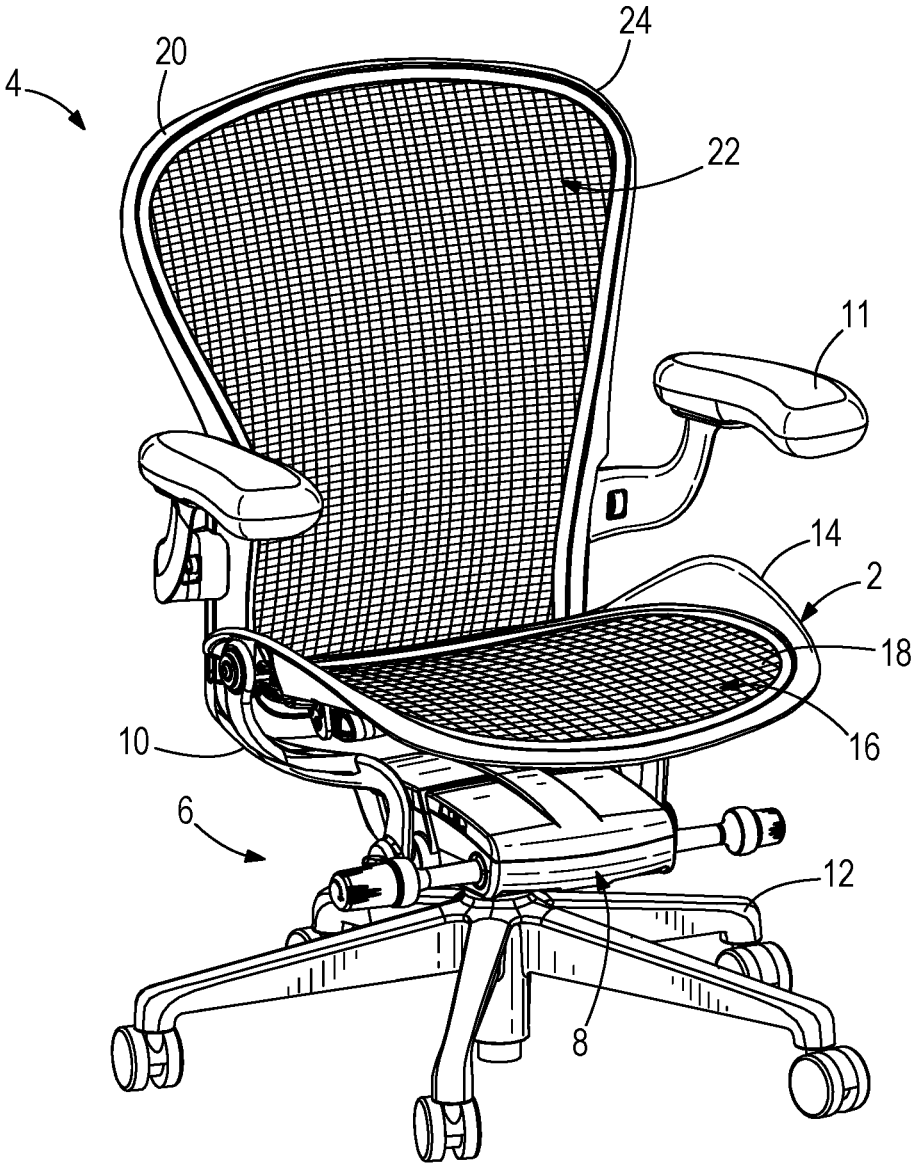
FIG. 1 is an exemplary embodiment of a task chair.

FIG. 1 shows an exemplary embodiment of a seating structure configured as a chair that includes a seat 2, a backrest 4 and a base 6. The base includes a tilt control housing 8, a support column 10 coupled to and supporting the tilt control housing 8 and a base structure 12 coupled to and supporting the support column 10. A pair of armrests 11 may be connected to the chair.

The seat 2 includes a frame 14, a suspension material 16, and a carrier 18. The carrier 18 retains the suspension material 16 and connects to the frame 14. In the exemplary embodiments shown, the frame 14 is formed as a ring having a front, a back, and a pair of sides defining an opening. The frame 14 may also be formed from side members, a top member, and a bottom member. Different sizes, shapes, and configurations of the frame 14 can be used according to aesthetics, ergonomics, space, or other considers. The frame 14 may be integrally formed as a single, homogenous unit, or formed of separate components.

The backrest 4 includes a frame 20, a suspension material 22, and a carrier 24. The carrier 24 retains the suspension material 22 and connects to the frame 20. In the exemplary embodiments shown, the frame 20 is formed as a ring having a front, a back, and a pair of sides defining an opening. The frame 20 may also be formed from side members, a top member, and a bottom member. Different sizes, shapes, and configurations of the frame 20 can be used according to aesthetics, ergonomics, space, or other considers. The frame 20 may be integrally formed as a single, homogenous unit, or formed of separate components.

Various methods of connecting the suspension material 16, 22 can be used, including bonding and adhesive or mechanical fasteners, such as staples, or in-molding. When the carrier 18, 24 is engaged with the frame 14, 20, the suspension material 16, 22 spans across the seat 2 and backrest 4 openings.

The suspension material 16, 22 may be made of a woven or knit material, including various elastomeric materials, or fabrics, or various molded polymeric materials. The seat 2 and backrest 4 may utilize the same type of material or different materials for the suspension material 16, 22. In various exemplary embodiments, the suspension material 16, 22 can include a plurality of monofilaments interlaced with a plurality of multifilament strands. The monofilaments 26 can be the primary load carrying members and run laterally in the warp direction of the seat 2 and backrest 4 while the multifilament strands run longitudinally in the weft direction. Additionally, monofilaments and/or multifilaments may be combined to run in both the lateral and longitudinal directions if necessary.

Figure 3:
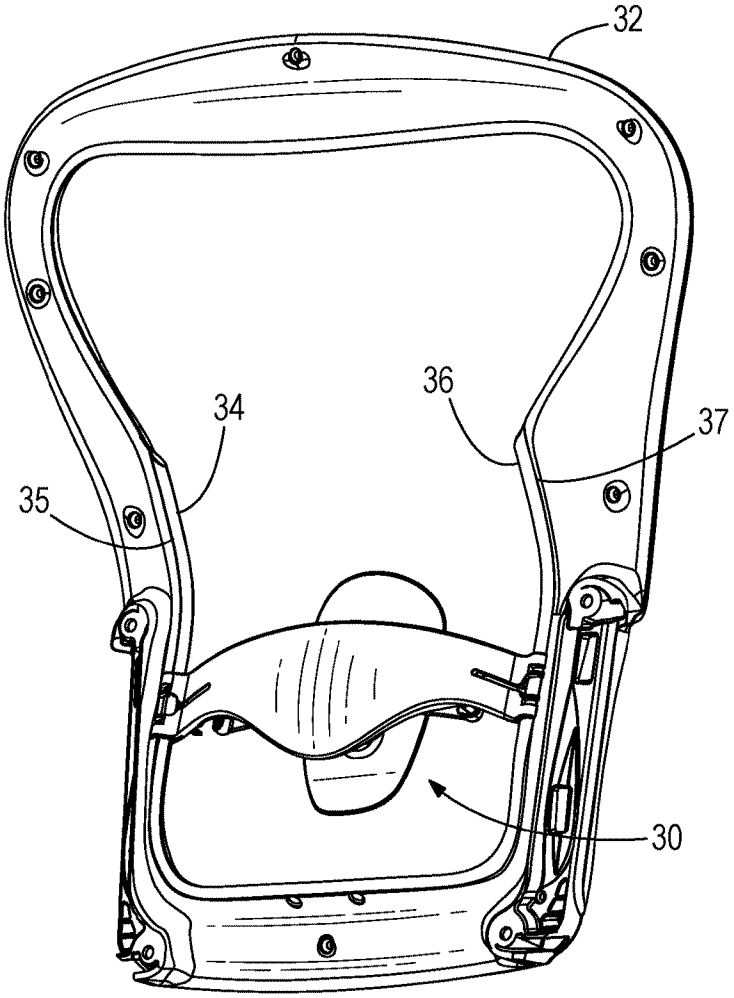
FIG. 3 is a rear perspective view of FIG. 2.
Figure 2:
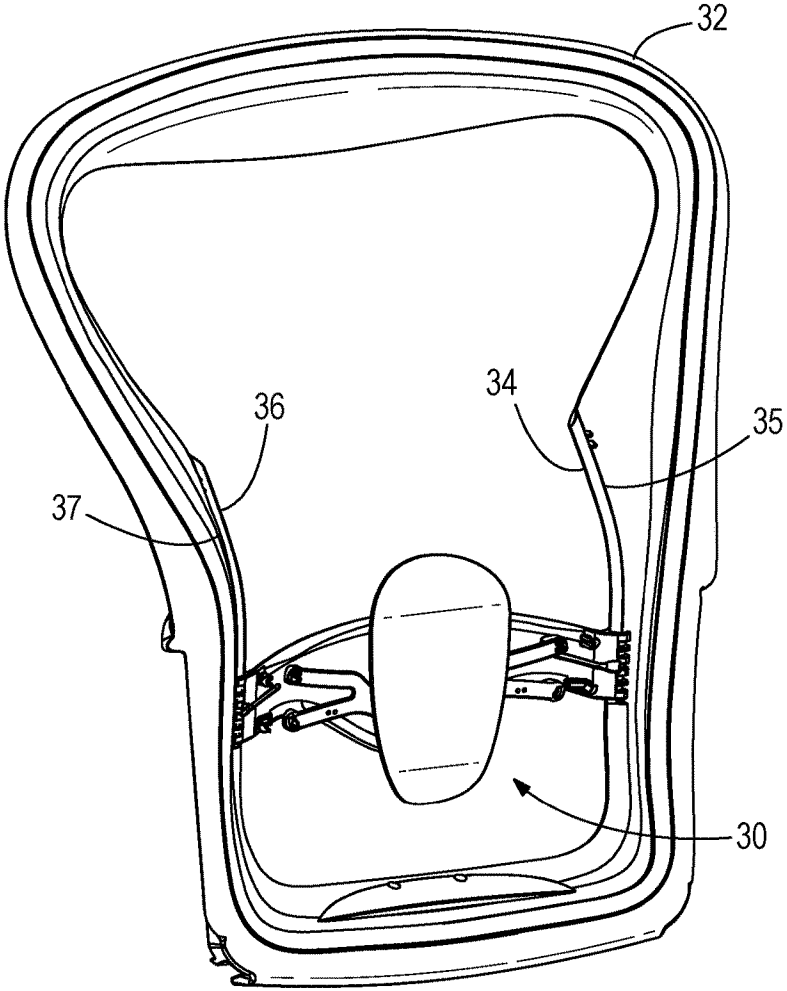
FIG. 2 is a front perspective view of an exemplary chair frame and support device.
Figure 4:
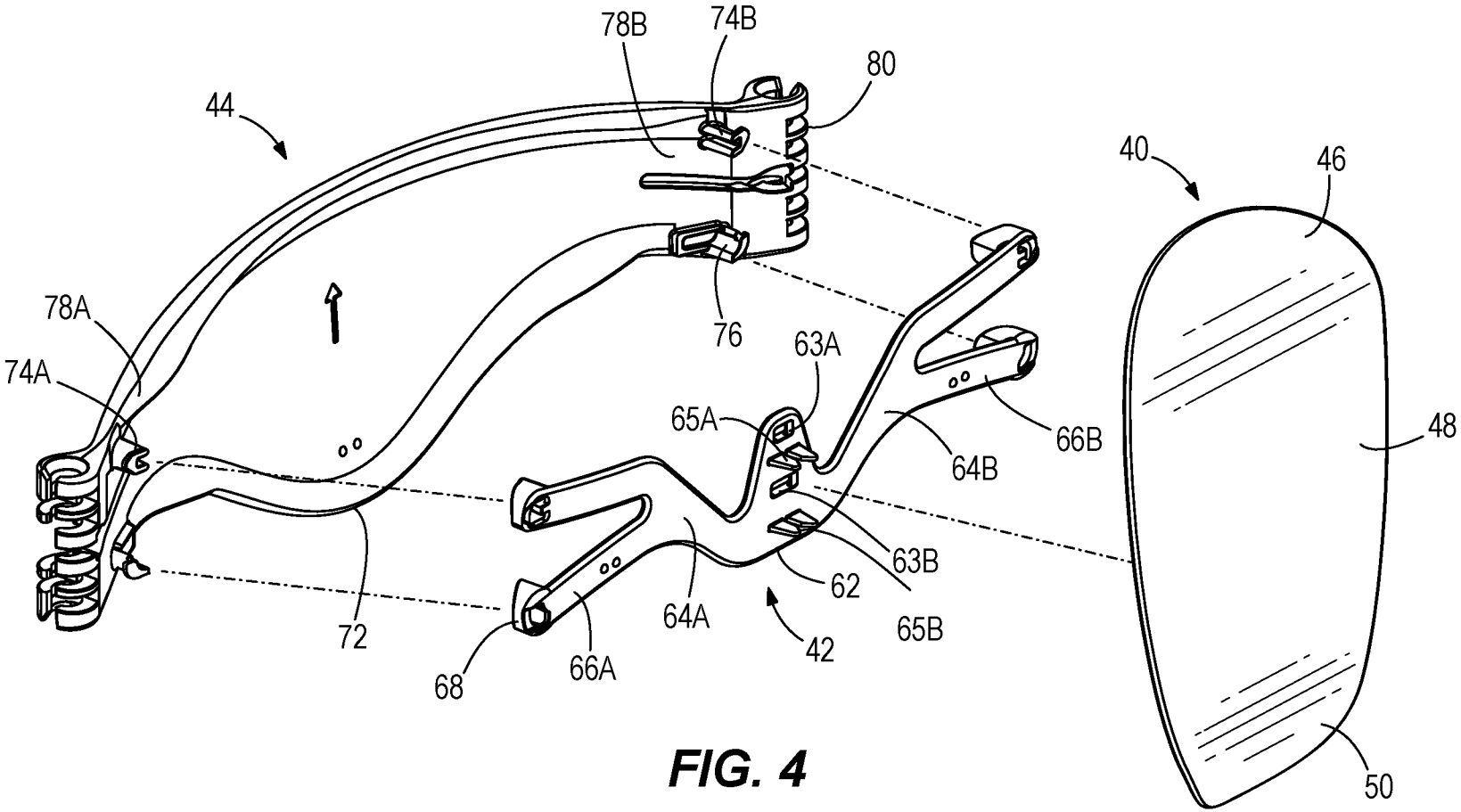
FIG. 4 is a front perspective, exploded view of the exemplary back support of FIG. 2.

FIGS. 2 and 3 show an adjustable back support 30 connected to an exemplary chair frame 32. The frame is illustrated as a ring having a front, a back, and a pair of sides defining an opening. The rear of the frame 32 includes a first rail 34 and a second rail 36 extending from respective sides. The back support 30 extends between and is slidably connected to the first and second rails 34, 36. In an exemplary embodiment, the first rail 34 includes a first narrowed portion or channel 35 on the front and back surface of the frame and the second rail 36 includes a second narrowed portion or channel 37 on the front and back surface of the frame. The back support 30 is vertically adjustable along the channels 35, 37 to provide support to different regions of a user's back, for example between and including the sacral region and the lumbar region.

FIGS. 4-10 show a back support 30 that includes a sled 40, a strap 42, and a cover 44. The sled 40 includes a front side facing a user and a rear side facing the strap 42 and cover 44. In an exemplary embodiment, the front of the sled 40 includes an upper portion 46, a central portion 48, and a lower portion 50. The upper portion 46 has a rounded edge and extends from the central portion 48 away from the chair frame 32, for example having one or more angled portions, curved portions, or a combination thereof. The lower portion 50 tapers toward the bottom and has a rounded edge. The lower portion 50 also extends from the central portion 48 away from the chair frame 32, for example having one or more angled portions, curved portions, or a combination thereof. The central portion 48 can have a substantially planar surface. The transition between the upper portion 46 and the central portion 48 and the transition between the lower portion 50 and the central portion 48 can be curved. Also, there can be a transition between the major interior surfaces of the upper portion 46, central portion 48, and lower portion 50 and the outer edge. This edge transition can include an angled surface, curved surface, or a combination thereof.

Figure 5:
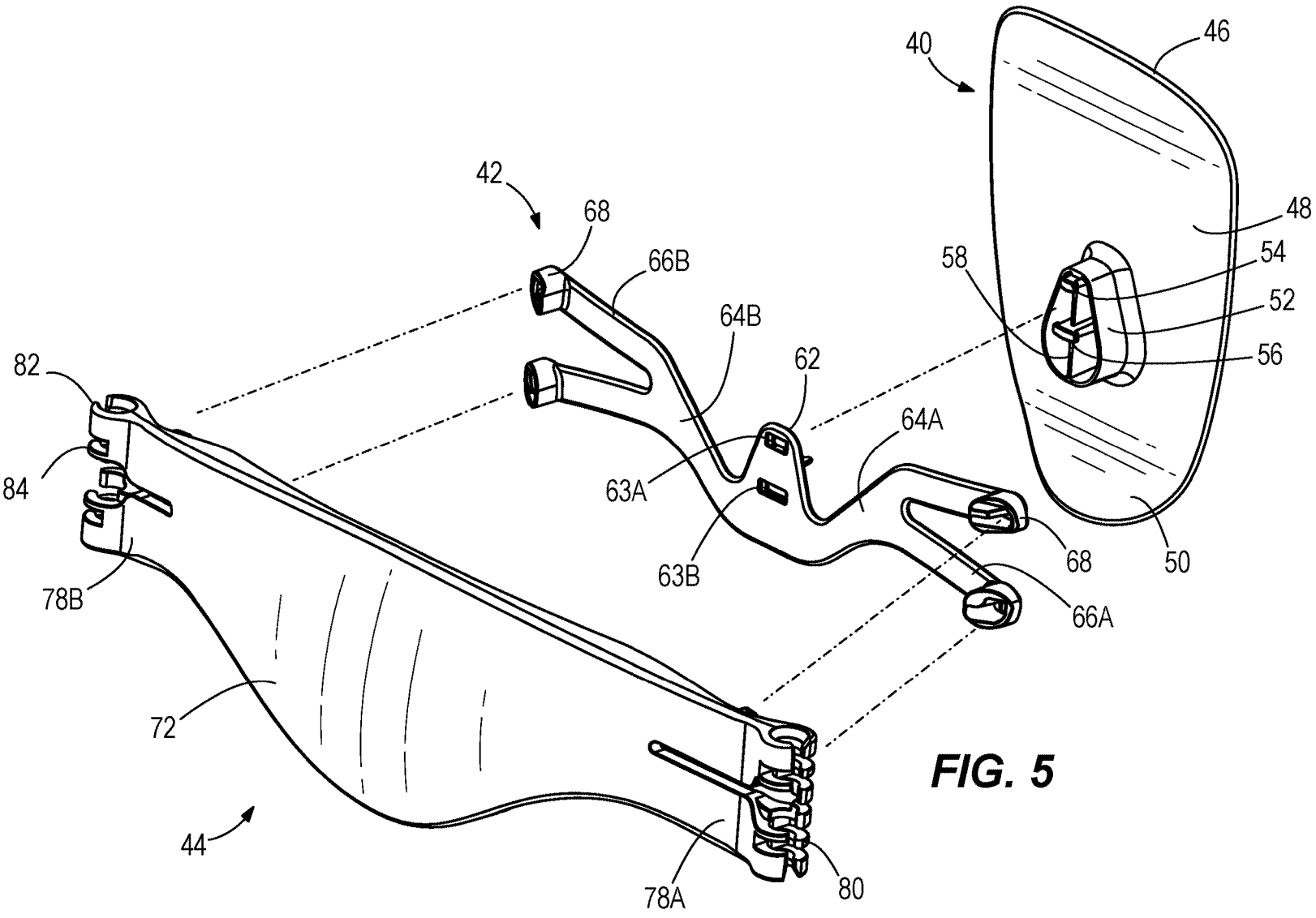
FIG. 5 is a rear perspective view of FIG. 4.
Figure 6:
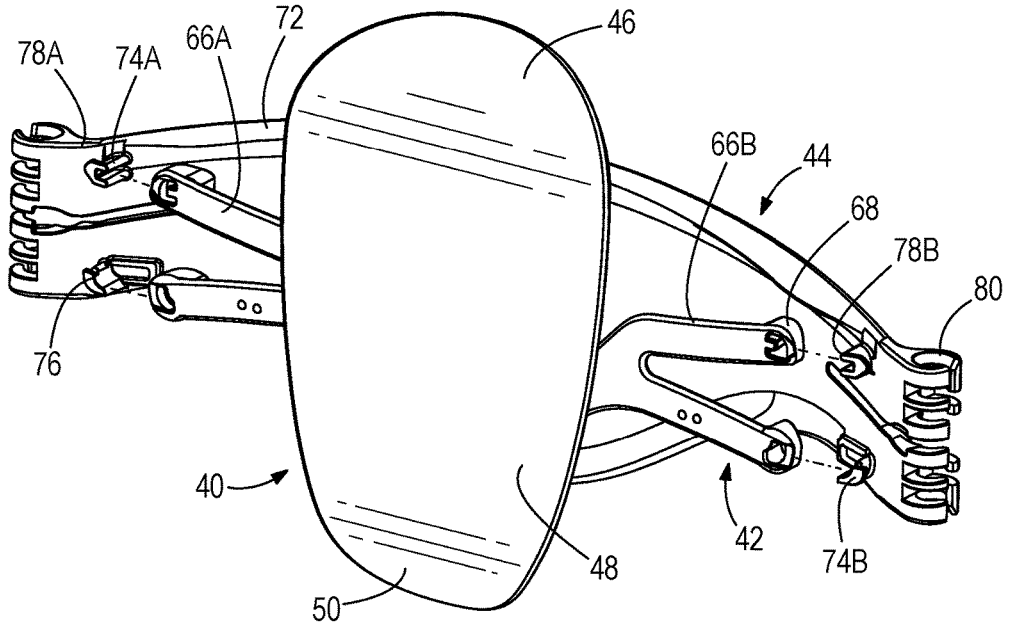
FIG. 6 is a front perspective view of the back support of FIG. 2 with the strap in an unstressed, pre-assembled state and the sled connected to the strap.
Figure 7:
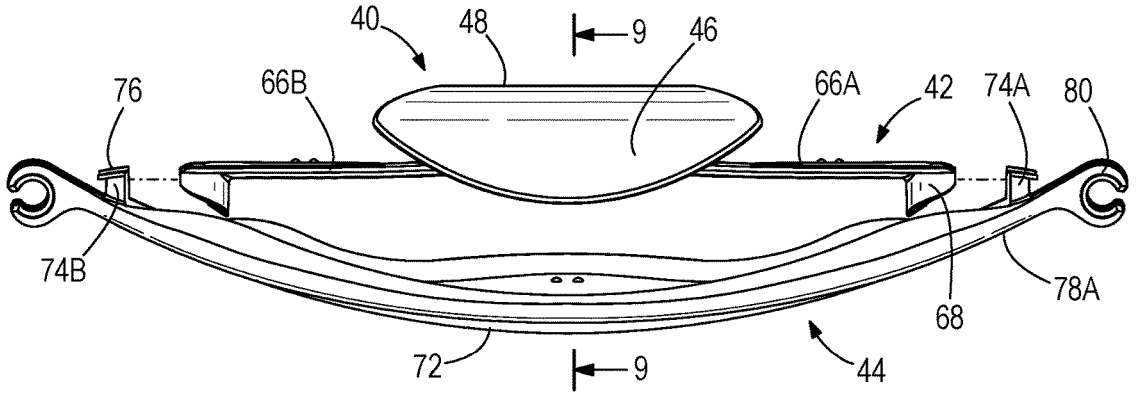
FIG. 7 is a top view of FIG. 6.
Figure 8:
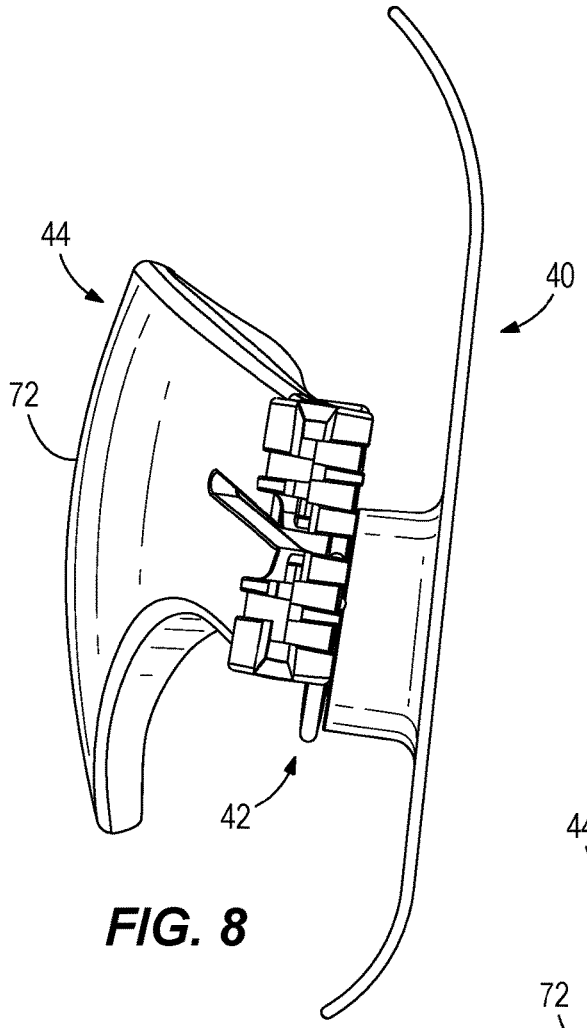
FIG. 8 is a side view of FIG. 6.
Figure 9:
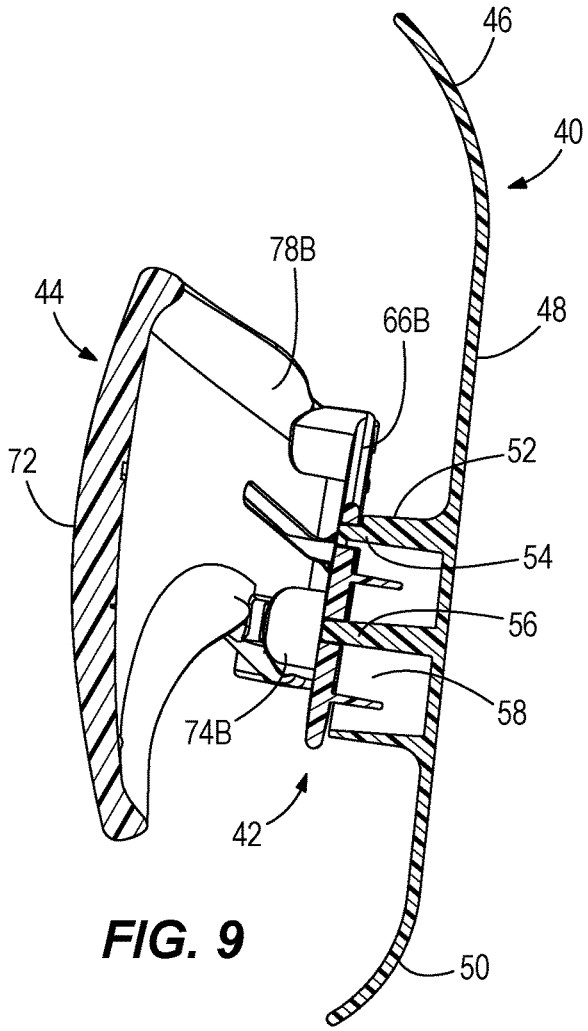
FIG. 9 is a sectional view of FIG. 8.

As best shown in FIG. 5, a connection member extends from the rear of the sled to connect the sled 40 to the strap 42. In an exemplary embodiment the connection member includes an outer ring 52 having a substantially teardrop shape surrounding one or more protrusions. The protrusions include a first inner bar 54, a second inner bar 56, and a cross bar 58 extending substantially perpendicular to the first and second inner bars 54, 56. The inner bars 54, 56 have one or more enlarged heads that enable a snap-fit connection with the strap 42. For example, the inner bars 54, 56 can have a substantially dumbbell shape.

The strap 42 includes a front side facing the sled 40, a rear side facing the cover 44. An inner portion 62 of the strap 42 includes a first opening 63A and a second opening 63B. The area of the openings decreases from the front of the strap to the back. A first set of tines 65A is positioned below the first opening 63A and a second set of tines 65B are positioned below the second opening 63B. The first opening 63A receives the first inner bar 54 and the second opening 63B receives the second inner bar 56 in a snap-fit connection. Each set of tines 65A, 65B are separated by a slot that receives a portion of the cross bar 58.

First and second arms 64A, 64B extend from opposite sides of the inner portion 62 of the strap 42. First and second branches 66A extend from the first arm 64A and third and fourth branches 66B extend from the second arm 64B. In an exemplary embodiment, the strap arms 64A, 64B and branches 66A, 66B extend from the inner portion 62 in a substantially gull-wing design. Each branch 66A, 66B includes a collar 68 extending toward the cover 44. The collar 68 at least partially defines an aperture that extends through the associated branch 66A, 66B.

The cover 44 includes a curved back wall 72 having a first set of strap connecting members 74A aligned with respective first and second branches 66A and a second set of strap connecting member 74B aligned with respective third and fourth branches 64B. The strap connecting members 74, 74B each include a protrusion extending from the back wall 72 toward the strap 42. The strap connection members 74A, 74B can include curved protrusions having and extending lip 76 for retaining the strap after it is stretched and positioned around the strap connecting member. The cover 44 includes a first set of connecting arms 78A and a second set of connecting arms 78B extending from the back wall 72, with each arm 78A, 78B including one or more curved prongs 80 defining an opening. The prongs 80 slidably engage the rails 34, 36 of the chair frame 32 with the distal ends of the prongs 80 engaging the channels 35, 37. In an exemplary embodiment, the prongs 80 each include an outer prong 82 having a first height and an inner prong 84 having a second height less than the first height as shown in FIG. 5.

Figure 10:
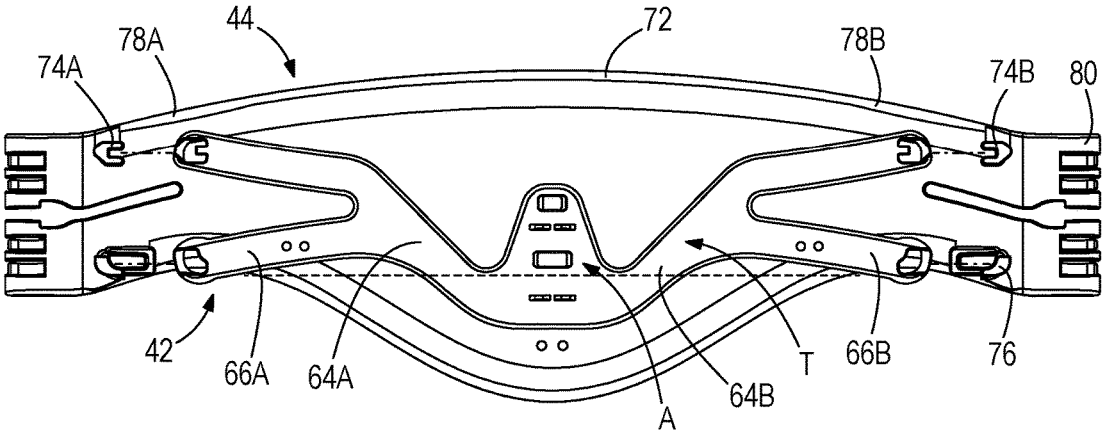
FIG. 10 is a front view of the exemplary cover and strap.

At least a portion of the strap 42 includes an elastic material, allowing the strap 42 to stretch to be connected to the cover 44. FIGS. 4-9 show the strap in an unstretched position prior to be connected to the cover. FIG. 10 shows arrows representing the stretch of the branches 66A, 66B to extend the collars 68 over the lip 76 and around the projections of the strap connecting members 74A, 74B. The strap 42 is configured to pivot about the axis A, and the tapered portion T of the arms 64 provides greater spring compliance due to the smaller cross sectional area.

Figure 11:
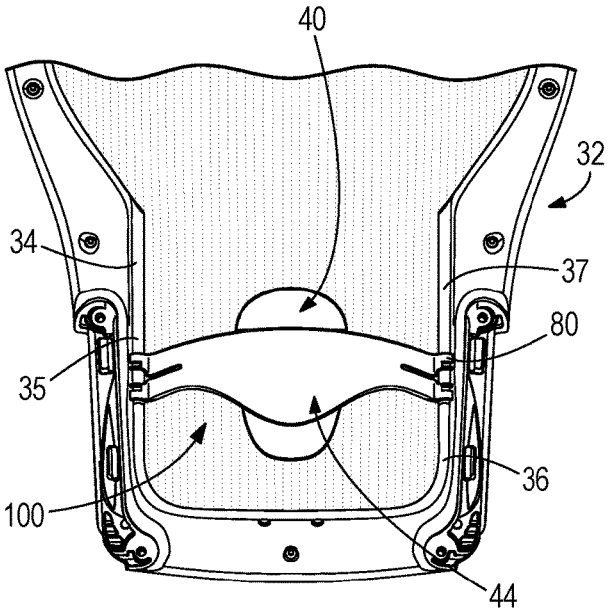
FIG. 11 is a rear view of an exemplary back support in a first position.
Figure 12:
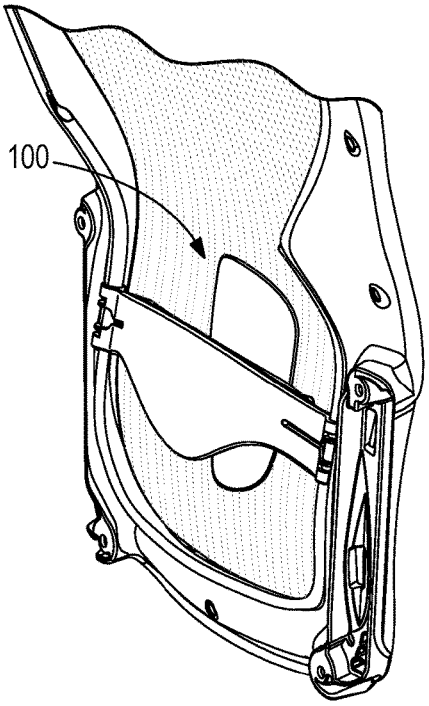
FIG. 12 is a side perspective view of FIG. 11.
Figure 13:
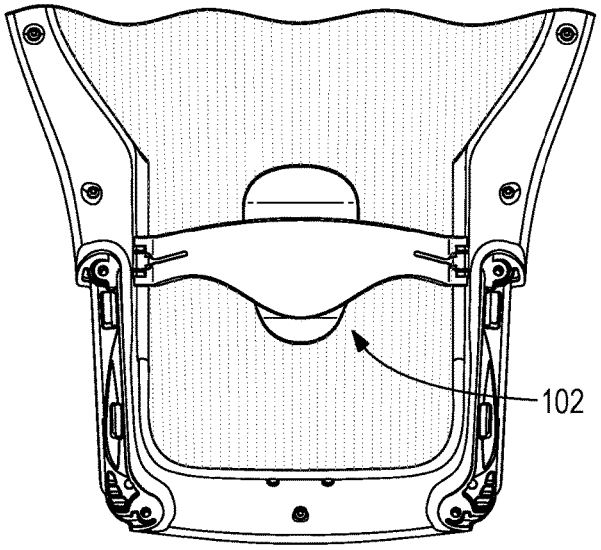
FIG. 13 is a rear view of the exemplary back support of FIG. 11 in a second position.
Figure 14:
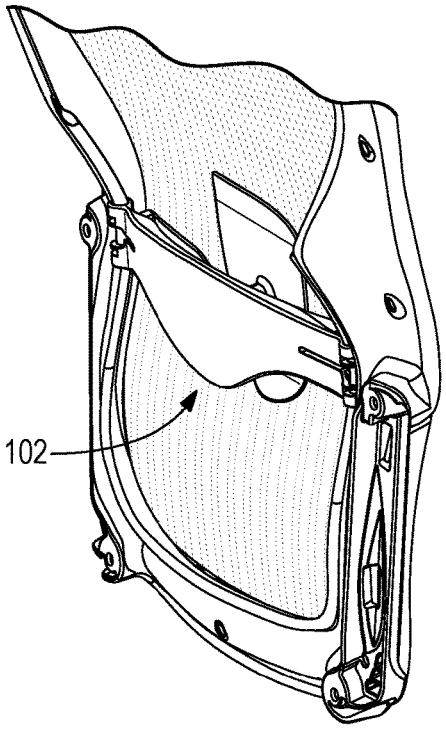
FIG. 14 is a side perspective view of FIG. 13.
Figure 15:
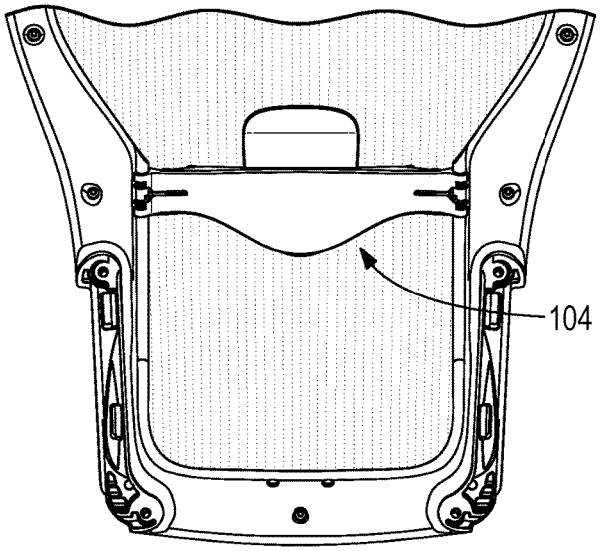
FIG. 15 is a rear view of the exemplary back support of FIG. 11 in a third position.
Figure 16:
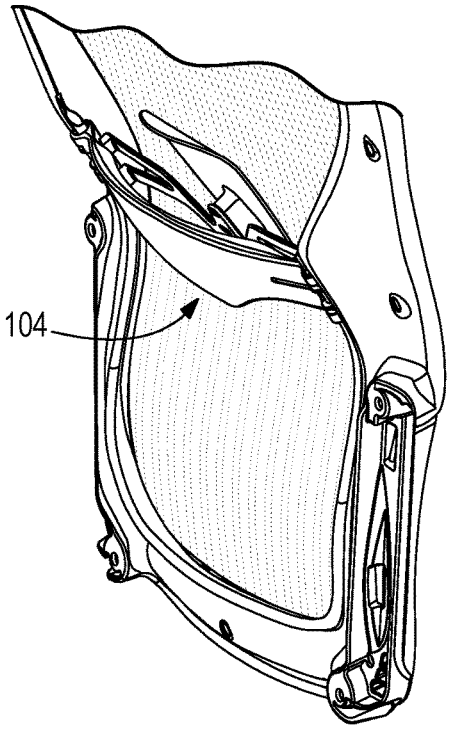
FIG. 16 is a side perspective view of FIG. 15.

The strap 42 can move or flex in toward the cover as a user sits in the chair and can also rotate as the support device 30 is moved, pivoting the sled 40. The support device 30 can be moved anywhere between a lower position and an upper position. FIGS. 11-12 show an example of the support device 30 in a lower or sacral position 100, FIGS. 13-14 show an example of the support device 30 in a mid position 102, and FIGS. 15 and 16 show an example of the support device 30 in an upper or lumbar position 104.

Figure 17:
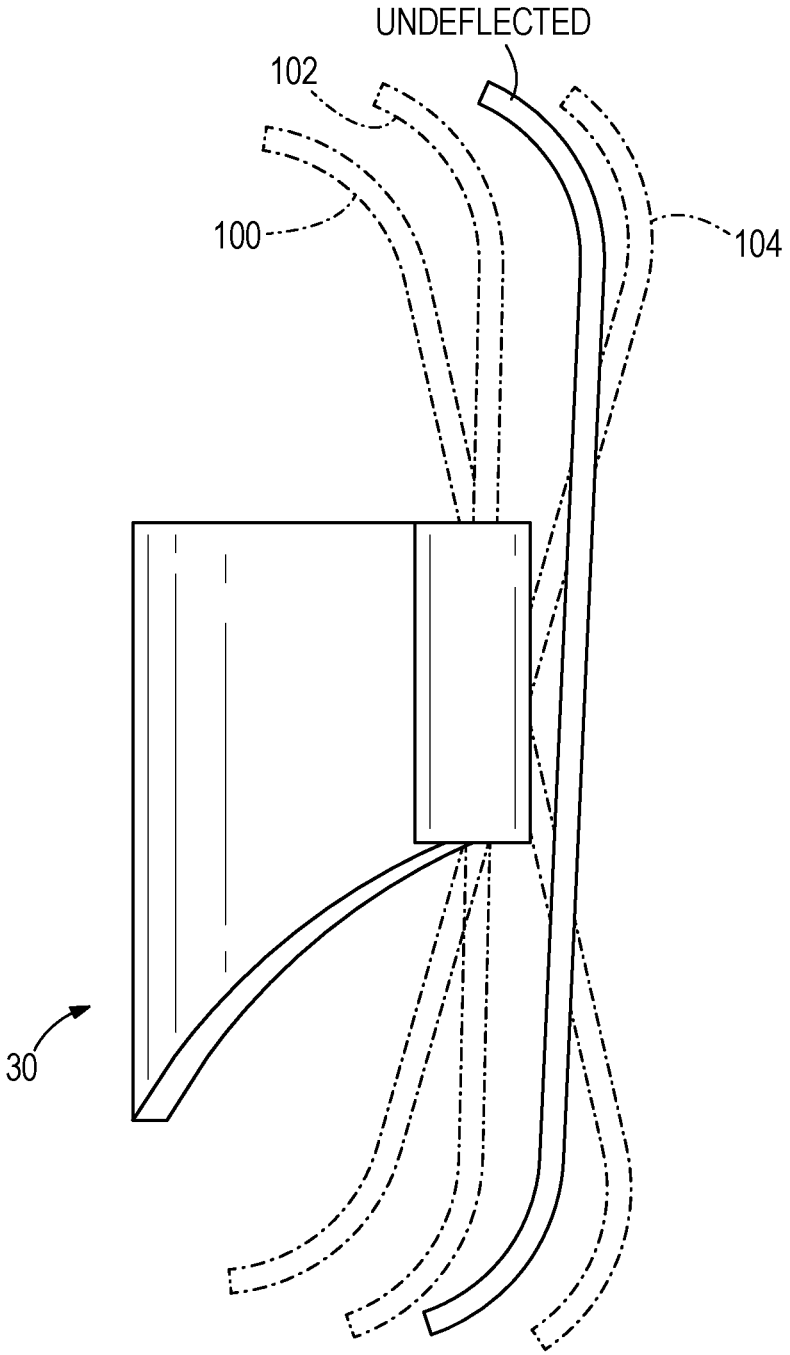
FIG. 17 is a schematic of a support member showing the different flexure positions.

As the support device 30 is moved, the sled 40 pivots between multiple positions (as shown in FIG. 17) so that the central portion 48 is angled to always be facing a user's back and the edges of the device will not catch or pinch the user through the chair back. For example, the sled 40 can pivot so that all or at least a portion of the central portion 48 is substantially parallel to a user back and/or to an adjacent suspension material through the entire range of motion of the 100, 102, 104 of the support member 30. In an exemplary embodiment, the range of motion of the system during use is in the range of approximately 0.15" deflection in the low or sacral position 100 up to approximately 0.5" deflection in the upper or lumbar position 104. The support member 30, for example the strap 42 can be configured to provide a spring force between above zero to approximately 5 lbs.

According to an exemplary embodiment, one or more portions of the sled 40 can be flexible or resilient to assist in the sled conforming to a user's back. For example, the upper portion 46 and the lower portion 50 can flex to conform to a user's back to provide additional comfort and support. The flexibility or resiliency can be a result of the material and the thickness of the material in certain regions.

Various exemplary embodiments can incorporate different materials and padding with any of the back support components. The size, shape, and configuration of the back support can also be varied depending on the chair and/or the type of support to be provided to a user.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A back support for a chair comprising:

a cover configured to be coupled to opposing sides of a chair frame;

a strap connected to the cover; and a sled having a central portion coupled to the strap, the sled configured to pivot with respect to the chair frame and provide support to a user's back, wherein the cover is configured to moveably connect to the chair frame between a low position and a high position, and wherein the sled is configured to pivot as the cover moves between the low position and the high position so that the central portion of the sled is substantially parallel to at least a portion of a membrane connected to the frame between the low position and the high position.

2. The back support of claim 1, wherein the sled includes an upper portion and a lower portion, and when the cover is in the first position the sled is pivoted so that the lower portion is positioned in front of the upper portion and when the cover is in the second position the sled is pivoted so that the upper portion is in front of the lower portion.

3. The back support of claim 2, wherein the upper portion includes a first curved section extending away from the frame and the lower portion and the lower portion includes a second curved section extending away from the frame.

4. The back support of claim 3, wherein the upper portion and the lower portion of the sled is flexible.

5. The back support of claim 1, wherein the cover includes a first connection point adjacent one side of the chair frame and a second connection point adjacent an opposite side of the chair frame, and the strap includes a first end coupled to the first connection point, a second end coupled to the second connection point, and an inner section between the first end and the second end.

6. The back support of claim 5, wherein the strap is tensioned between the first and second connection points.

7. The back support of claim 1, wherein the strap includes an inner portion, a first arm extending from the inner portion, a first branch and a second branch extending from the first arm, a second arm extending from the inner portion, and a third branch and a fourth branch extending from the second arm.

8. The back support of claim 1, wherein the cover includes a first connecting arm and a second connecting arm, and wherein each of the connecting arms includes a prong configured to engage a rail member on the chair frame.

9. A back support for a chair comprising:

a cover configured to extend across an opening of a backrest and be coupled to opposing sides of a chair frame, the cover including a first connection point adjacent one side of the frame, and a second connection point adjacent an opposite side of the frame;

a strap having a first end coupled to the first connection point of the cover, a second end coupled to the second connection point of the cover, and a central section between the first end and the second end, the strap being tensioned between the first and second connection points; and a sled coupled to the central section of the strap and pivotable with respect to the cover, the sled configured to engage a membrane connected to the frame to support a user.

10. The back support of claim 9, wherein the sled includes an upper portion having a first curved section extending away from the frame and a lower portion having a second curved section extending away from the frame.

11. The back support of claim 9, wherein the sled is snap-fit to the strap by a connection member.

12. The back support of claim 11, wherein the connection member includes a first inner bar, a second inner bar, and a cross bar extending substantially perpendicular to the first and second inner bars.

13. The back support of claim 9, wherein the strap includes an inner portion, a first arm extending from the inner portion, a first branch and a second branch extending from the first arm, a second arm extending from the inner portion, and a third branch and a fourth branch extending from the second arm.

14. The back support of claim 13, wherein the first arm, second arm, first branch, second branch, third branch, and fourth branch have a gull-wing configuration.

15. The back support of claim 9, wherein the cover includes a curved back wall defining an opening and the strap extends across a portion of the opening of the curved back wall.

16. The back support of claim 9, wherein the cover is configured to moveably connect to the chair frame between a low position and a high position, and wherein the sled is configured to pivot as the cover moves between the low position and the high position so that the central portion of the sled is aligned with the user's back when moving between the low position and the high position.

17. The back support of claim 9, wherein at least a portion of the sled is flexible.

18. A chair comprising:

a base;

a seat supported by the base;

a backrest adjacent the seat and including a frame defining a central opening and a membrane coupled to the frame and suspended over the central opening;

a cover connected to the frame;

a strap connected to the cover; and a sled connected to the strap, the sled configured to pivot with respect to the chair frame and provide support to a user's back, wherein the cover is configured to moveably connect to the frame between a low position and a high position, and wherein the sled is configured to pivot as the cover moves between the low position and the high position so that the central portion of the sled is substantially parallel to at least a portion of the membrane.

19. The chair of claim 18, wherein the frame includes a first rail and a second rail and wherein the cover is connected to the first and second rails.

20. The chair of claim 19, wherein the first rail includes a first channel and the second rail includes a second channel, an wherein the cover includes a first set of connecting arms connected to the first channel and a second set of connecting arms connected to the second channel.

21. The back support of claim 18, wherein the sled includes an upper portion and a lower portion, and when the cover is in the first position the sled is pivoted so that the lower portion is positioned in front of the upper portion and when the cover is in the second position the sled is pivoted so that the upper portion is in front of the lower portion.

22. The back support of claim 18, wherein the cover includes a first connection point adjacent one side of the chair frame and a second connection point adjacent an opposite side of the chair frame, and the strap includes a first end coupled to the first connection point, a second end coupled to the second connection point, and an inner section between the first end and the second end.

23. The back support of claim 18, wherein at least a portion of the sled is flexible.

* * * * *